US005838260A

United States Patent [19]

Liu

[11] Patent Number: 5,838,260

[45] Date of Patent: Nov. 17, 1998

[54] TRAFFIC SIGNALING DEVICE HAVING SEQUENTIALLY CONTROLLED LIGHT BARS

[76] Inventor: Shu Lien Liu, 2FL. 33, Lane 52, Szu-Wei Road, Taipei, Taiwan

[21] Appl. No.: 957,037

[22] Filed: Oct. 24, 1997

[51] Int. Cl.[6] ..... G08G 1/95

[52] U.S. Cl. ..... 340/907; 340/903; 340/929

[58] Field of Search ..... 340/903, 907, 340/929, 930, 944, 908, 908.1

[56] References Cited

U.S. PATENT DOCUMENTS

| | | | |
|---|---|---|---|
| 3,161,853 | 12/1964 | Hart | 340/907 |
| 3,200,218 | 8/1965 | Wagner | 340/929 |
| 3,408,623 | 10/1968 | Wagner | 340/929 |
| 4,167,001 | 9/1979 | Gilmore | 340/929 |
| 4,839,647 | 6/1989 | Patterson | 340/907 |
| 5,726,648 | 3/1998 | Soon | 340/907 |

*Primary Examiner*—Jeffery A. Hofsass
*Assistant Examiner*—Van T. Trieu
*Attorney, Agent, or Firm*—Kenneth Q. Lao

[57] ABSTRACT

The present invention relates to a traffic signaling device comprising a plurality of light bars which can be sequentially controlled and switched on/off to provide a dynamic signal to the drivers and pedestrians. The color of the light bars can turn red to indicate a stop signal or green to allow the traffic to proceed. The light bars can be switched off in a sequence to advise the drivers and the pedestrians as how much time is left before one color is replaced by another color. With this arrangement, the drivers and the pedestrians can adjust their pace when they are passing a crossroad. Preferably, the top portion of each of the signaling devices is shaped to show the traffic directions. For example, the top portion can be shaped to indicate left-turning, right-turning, straight forward, etc. Moreover, the bottom of the signaling device can he also attached with a road sign to assist a driver to find his or her way.

11 Claims, 5 Drawing Sheets

TRAFFIC SIGNALING DEVICE HAVING SEQUENTIALLY CONTROLLED LIGHT BARS

FIELD OF THE INVENTION

The present invention relates to a traffic signaling system, more particularly, to a traffic signaling device configured by a plurality of light bars which can be sequentially and separately controlled and switched on/off to provide a dynamic signal to the drivers and pedestrians.

PRIOR ART

Traffic light which has red, yellow and green indicators is widely used on a crossroad to regulate the vehicles and pedestrians in different directions. However, there is still room to improve the existing traffic light to increase the convenience as well as the traffic safety.

On an existing traffic light, one indicator will only flash for a short period of time before the other illuminates. Normally, the yellow indicator illuminates only a few seconds before the red indicator illuminates. In the light of this, the drivers and/or the pedestrians do not exactly know the remaining time for passing before the yellow or the red indicators illuminates. As the yellow and red indicators may come immediately after the flash of the green light, the drivers may run a red light because there is no time to correspond to this quick change. Otherwise, one vehicle may bump into another vehicle in the front which has stopped abruptly. Moreover, there is no indication as when the red light is going to change into a green light. If the leading vehicles do not notice this light change while the following ones do. The drivers of the following vehicles may become impatient and blow the horn. If both drivers are not well mannered, a conflict may be raised between the drivers. As a result, the traffic flow will be badly influenced.

Besides, the existing traffic light at a pedestrian crossing does not provide a means for the pedestrians to estimate the remaining time for passing. If the remaining time for passing is short, the green light may change into red while the pedestrians are still in the crossing. This is really a dangerous situation. Similarly, when the pedestrians are waiting at a red light, he or she has no idea as when the red light is going to change. It is advantageous to provide an improvement over the existing traffic light.

SUMMARY OF THE INVENTION

It is an objective of the present invention to provide a traffic signaling system with which both the drivers and the pedestrians can be well advised as how much time is left for passing or waiting.

It is another objective of the present invention to provide a traffic signaling device in which a plurality of light bars which can he sequentially controlled are used to provide a dynamic signal to the drivers and pedestrians. Accordingly, the drivers and the pedestrians are clearly advised as when to pass, when to stop, and how much time is left for passing a transient zone or waiting at a red light. As a result, the transient zone can always be cleared in time to make the traffic flow more smoothly.

According to one embodiment of the present invention, the lowermost light bar in the traffic signaling device is switched off to indicate that the traffic light is going to change. When the signal is green and the light bars are gradually and sequentially switched off and replaced by the clearing light, the vehicles and pedestrians that are already in the transient zone must proceed promptly to clear the transient zone. But those are not yet in the transient zone must not enter. With this arrangement, the transient zone can always be kept clear. Similarly, the lowermost light bar can also be used to indicate the forthcoming change from a stop signal to a "go" signal. Upon seeing such an indication, the drivers and the pedestrians are advised to prepare for moving or crossing. As a result, the traffic flow can be smoothly and quickly regulated.

According to yet another aspect of the present invention, the upper portion of the signaling device is shaped to indicate the traffic directions. For example, the upper portion can be shaped to indicate left-turning, right-turning, straight forward or just a slight turn. A group of such signaling devices can be installed at a crossroad to separately indicate which directions are already cleared for traffic to proceed. Furthermore, the lower portion of the signaling device can be provided with a road sign bearing the name of the road.

BRIEF DESCRIPTION OF DRAWINGS

In order that the present invention may be more readily understood the following description is given, merely by way of examples with reference to the accompanying drawings, in which:

FIG. 4 illustrates the situation of green light; FIG. 5 illustrates the situation of red light; and FIG. 6 indicates a clearing signal.

DETAILED DESCRIPTION OF THE PREFERRED EMBODIMENTS

Figure 1B:
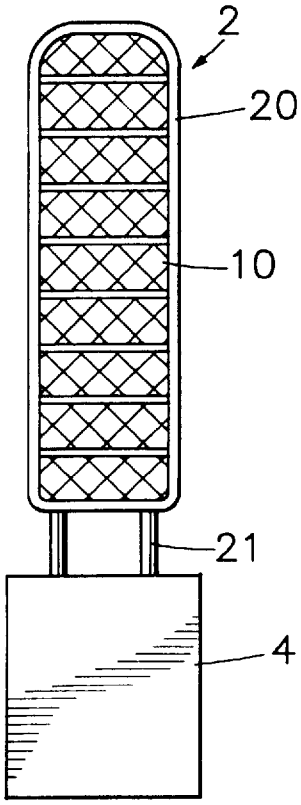
FIGS. 1, 1A and 1B are front views of a signaling device showing the light bars being switched off from the lowermost one to the higher ones in a sequential fashion.
Figure 1A:
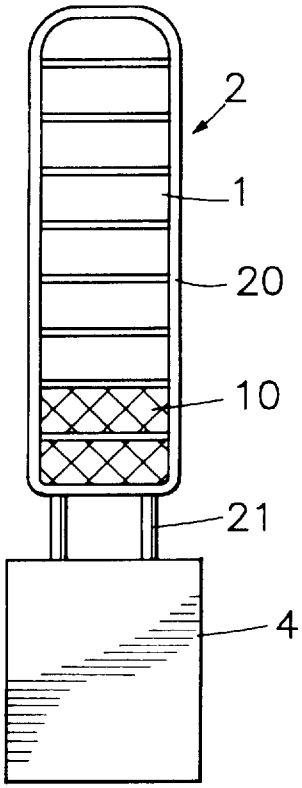
Figure 1:
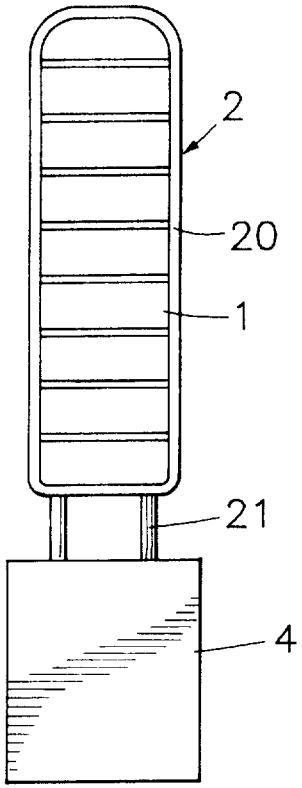

Referring to FIG. 1, the traffic signaling device 2 is configured by a plurality of horizontally arranged light bars 1 disposed within a housing 20. Each light bar 1 can be changed from one color to another. For example, the color can change from green to red, and from red into green again. Furthermore, in the transient period between the green light and red light, a clearing signal 10 can be turned on to indicate the forthcoming change. The clearing signal is represented by the cross-shading area shown in FIG. 1A and FIG. 1B. A clearing signal usually starts from the lowermost light bar and gradually moves upward. Such a signal can be used to indicate how much time is left before the light is changed from green to red. Since the signaling device 2 can be installed at different crossroad, the duration of the clearing signal is designed to suit the normal speed of vehicles and pedestrians, taking into account the width of the crossing. For example, when the light bars 1 are all switched on to show a green signal, as shown in FIG. 1A, all the vehicles and pedestrians which follow this green light are allowed to pass through the crossroad. But when the lowermost light bar 1 is switched off to start showing the clearing signal, those vehicles and pedestrians who have not entered the transient zone are not allowed to do so. However, those have already entered should keep on moving to clear out the transient zone. After all the green light bars are switched off, they are switched on again to show a red signal. With this arrangement, the transient zone can always be cleared in time. Similarly, the light bars (in red color) can be gradually switched off, from the lower bars to the higher bars, to indicate the forthcoming change from the red light to green. With such a signal, the stopping vehicles and the waiting pedestrians can anticipate a "go" signal to happen. When only a few red light bars are switched off, the vehicles and pedestrians can get ready to move, so that when the green light is on they can start moving immediately. With this arrangement, the traffic flow can be more efficiently controlled.

Figure 1C:
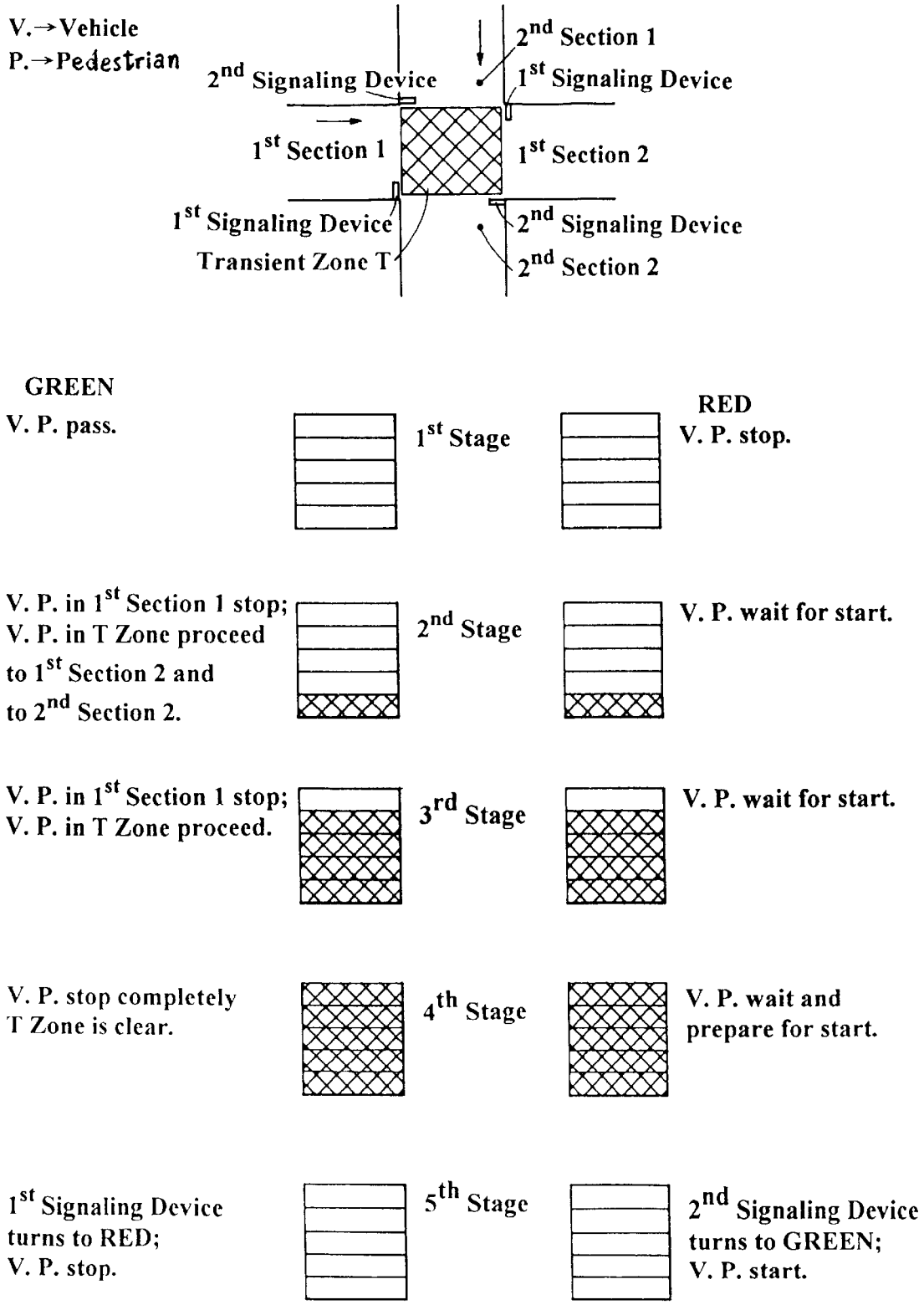
FIG. 1C is a schematic illustration showing the operation of the signaling devices in a crossroad.

FIG. 1C shows a schematic illustration of the application of the signaling device 2. As shown in FIG. 1C, the vehicles and pedestrians in a crossroad include those who are moving in a horizontal direction (hereinafter referred to as the 1st direction) and passing from the 1st section 1 through the transient zone T into the 1st section 2. Similarly, in another direction (i.e. vertical direction or 2nd direction), the vehicles and pedestrians are moving from 2nd section 1 to the 2nd section 2 through the transient zone T.

It is assumed that the 1st signaling device is green and the 2nd signaling device is red in the very beginning, i.e. the 1st stage shown in FIG. 1C. In this 1st stage, the vehicles and pedestrians in the 1st direction are allowed to enter from 1st section 1 into the 1st section 2 or from 1st section 1 to 2nd section 2 (turning right) through the transient zone T. At the same time, the vehicles and pedestrians in the 2nd direction are waiting to cross. When the lowermost green light bar 1 of the 1st signaling device is switched off and converted into a clearing light which is represented by the cross-shading area, as shown in the 2nd stage of FIG. 1C, the vehicles and pedestrians within the 1st section 1 must stop while the vehicles and pedestrians within the transient zone T are allowed to proceed and enter into the 1st section 2 or 2nd section 2. At the same time, the lowermost red light bar of the 2nd signaling device is also switched off and converted into a clearing light. Accordingly, the drivers and pedestrians in the 2nd direction are advised that the signaling device is going to change into a green light. Both the drivers and the pedestrians can estimate the remaining waiting time as the red light bars are switched off in sequence.

Subsequently, the clearing signal in both the 1st and 2nd signaling devices are gradually increased till all of the light bars 1 are switched off as shown in the 4th stage in FIG. 1C. It is followed that the clearing light in the 1st signaling device are converted into red light while the clearing light in the 2nd signal device are converted into green light. When this happens, the vehicles and pedestrians in the 2nd direction are allowed to pass through the transient zone T from the 2nd section 1 into 2nd section 2 or the 1st section 1 (turning right). In this event, both the 1st and 2nd signaling devices are experienced through the 1st to 5th stages and now their functions are reversed.

Figure 2:
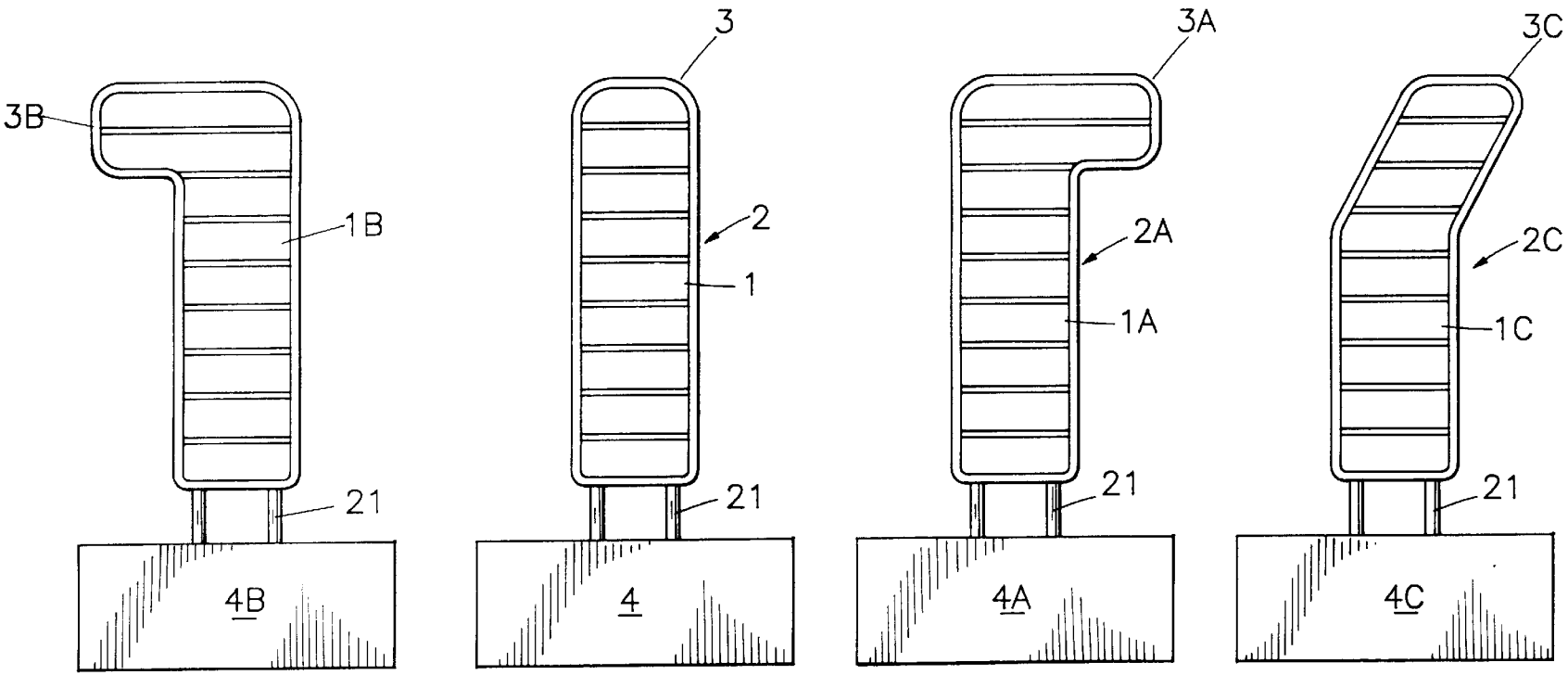
FIG. 2 is a plane view of a plurality of signaling devices having the top portion shaped to indicate a left-turn, right-tun, a forward direction or a slight turn. In addition, the bottom of each of the signaling devices is provided with a road sign.

Referring now to FIG. 2, the upper portion of the signaling device 2 is shaped to show different traffic directions. By this provision, the driver can be readily advised by the shape as in which direction the traffic is currently allowed to proceed. For example, the upper portion 3A on the signaling device 2A is used to indicate that right-turn is allowed, while the upper portion 3 on the signaling device 2 is used to signal the drivers to move forward. Furthermore, the signaling device 2 can be also combined with a road sign 4 bearing the name of the road. As a result, the driver can be readily advised as which road is allowed to pass. This may reduce the anguish and nervousness of the drivers who are unfamiliar with the area.

Figure 3:
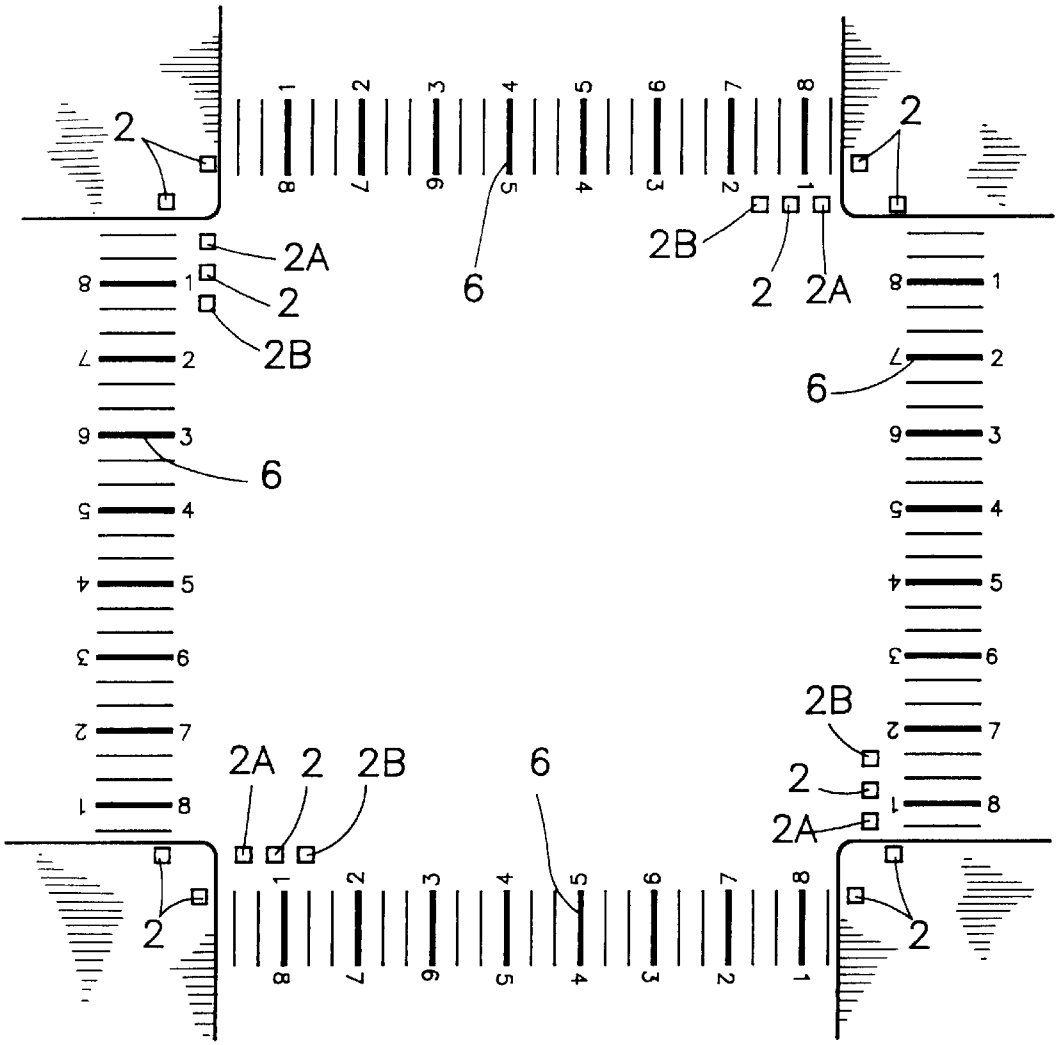
FIG. 3 is a top view showing a traffic signaling system having a plurality of signaling devices installed at a crossroad.

FIG. 3 illustrates a traffic signaling system which includes a plurality of signaling devices installed at the crossroad and additional devices stalled along the pedestrian crossing. As shown in FIG. 3, the signaling device 2 in which the light bars 1 are sequentially controlled (see FIG. 1) can be disposed at the pedestrian crossing for the use by pedestrians. But they can also be used as traffic lights for vehicles. Furthermore, signaling devices having direction indicating portion as shown in FIGS. 2, 2A, and 2B can also be installed at various corners to replace the arrows in conventional traffic lights. Moreover, a plurality of light bars 6 can be installed along a pedestrian crossing. Preferably, the light bars 6 appear differently from the painted bars in a conventional pedestrian crossing. Also, it is preferred that the number of light bars 6 be equal to the number of light bars 1 on the signal device 2 (see FIG. 1) so that the crossing light bars 6 can be switched on or off in synchronism with the light bars 1 on a signal device 2. With the installation of the crossing light bars, the pedestrians will be aware of the signal change without looking at the signaling device.

Figure 6:
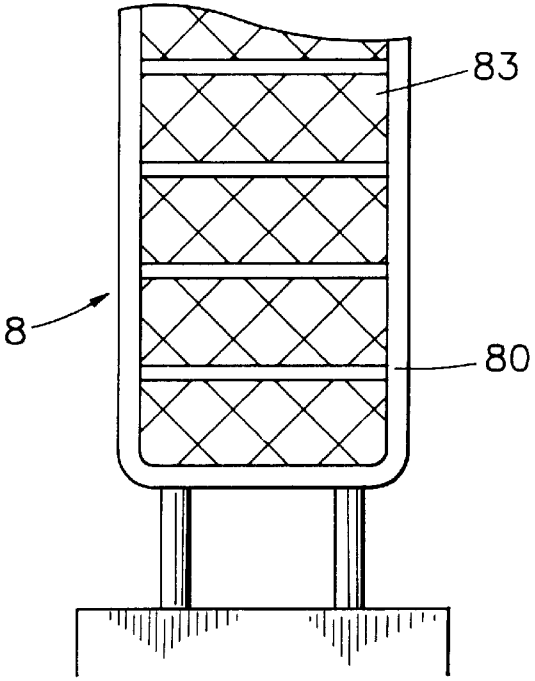
FIGS. 4, 5 and 6 are the plane views of the signaling devices which have been adapted to assist people who suffer from color blindness.
Figure 5:
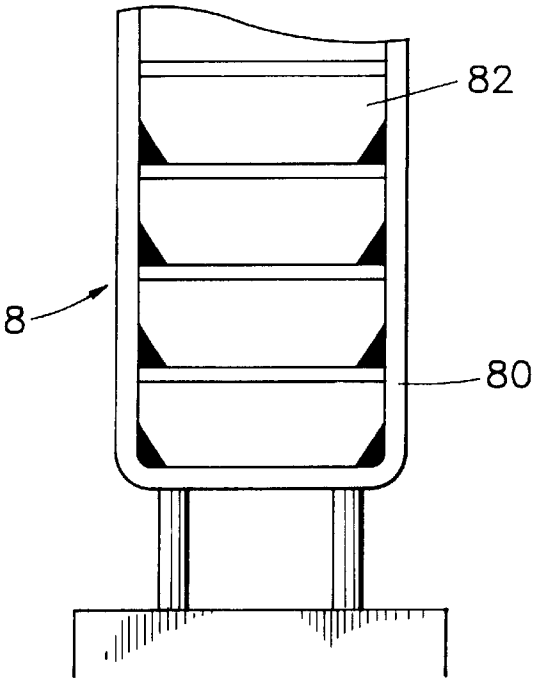
Figure 4:
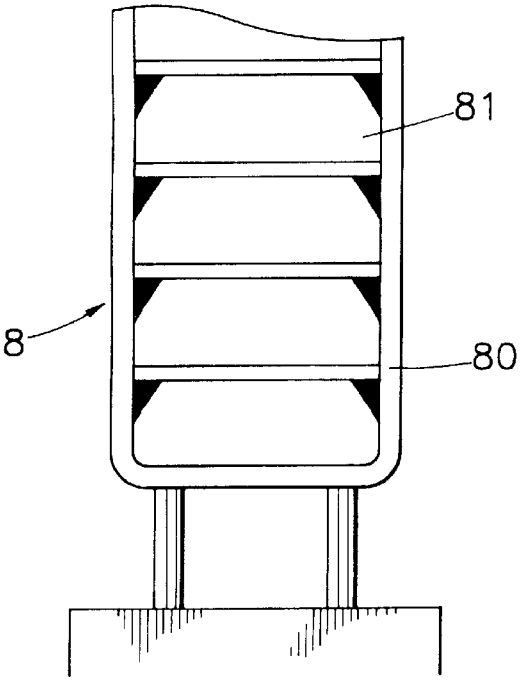

In another alternative approach, the light bar 1 of the signaling device 2 can be shaped such that it can be readily and easily recognized by the color blind. These light bars are shown to be installed in a housing 80 on a signaling device 8 in FIG. 4–FIG. 6. The light bar is provided with a trapezoid shape 81 to simulate a green light situation, as shown in FIG. 4, and an up-side-down trapezoid shape 82 to simulate a red light situation. With this arrangement, during the transition between the green and red lights, the light bars 81 and 82 are respectively switched off, from the lowermost bar to the higher bars, to be converted into a clearing light 83. The shaping of the light bars will benefit the drivers and pedestrians who suffer from color blindness.

While particular embodiments of the present invention have been illustrated and described, it would be obvious to those skilled in the art that various changes and modifications can be made without departing from the spirit and scope of the invention. It is therefore intended to cover in the appended claim all such changes and modifications that are within the scope of the present invention.

I claim:

1. A traffic signaling system to be installed in the proximity of a pedestrian crossing, said signaling system comprising at least one signaling device characterized in that said signaling device is configured by a plurality of horizontally-arranged light bars which can be converted to different colors to indicate a signal to proceed and a signal to stop the traffic, said light bars being sequentially and separately switched on and off to provide a dynamic traffic signal, said light bars forming a top section of said signaling device said top section having a direction-pointing shape to indicate the traffic flow being directed to the right left or straight-forward direction.

2. The traffic signaling system of claim 1 wherein said signaling device comprises a road sign bearing the name of a road.

3. The traffic signaling system of claim 1 further comprising a plurality of signal bars disposed in the pedestrian crossing, said signal bars being switched on and off and converted to different colors in synchronism with the light bars in said signaling device.

4. The traffic signaling system of claim 1 wherein the light bars in said signaling device are provided with different shapes for representing different colors to aid the color blind.

5. The traffic signaling system of claim 4 wherein said shapes include a trapezoid.

6. The traffic signaling system of claim 4 further comprising a road sign bearing the name of a road.

7. A traffic signaling device comprising a plurality of horizontally-arranged light bars which can be converted to different colors to indicate a signal to proceed and a signal to stop the traffic, said light bars being sequentially and separately switched on and off to provide a dynamic traffic signal; said light bars being provided with different shapes representing different colors for aiding the color blind.

8. The traffic signaling device of claim 7 wherein said shapes include a trapezoid.

9. The traffic signaling device of claim 7 further comprising a road sign.

10. The traffic signaling device of claim 7 wherein said light bars form a top section of said traffic signaling device shaped to indicate a traffic direction.

11. The traffic signaling device of claim 10 further comprising a road sign bearing the name of a road.

* * * * *